United States Patent [19]

Juntti

[11] Patent Number: 4,513,182

[45] Date of Patent: Apr. 23, 1985

[54] LIGHTBULB SOCKET

[76] Inventor: Lars Juntti, Poppovägen 19, 82500 Iggesund, Sweden

[21] Appl. No.: 433,703

[22] Filed: Oct. 12, 1982

[30] Foreign Application Priority Data

Oct. 13, 1981 [SE] Sweden ..... 8106047

[51] Int. Cl.[3] ..... H01R 33/18

[52] U.S. Cl. ..... 200/51.09; 200/51.10

[58] Field of Search ..... 200/51.09, 51.12, 51.14, 200/51.10; 339/1 L, 111, 278 L

[56] References Cited

U.S. PATENT DOCUMENTS

| | | | |
|---|---|---|---|
| 2,004,201 | 6/1935 | Goodlin et al. | 339/278 L |
| 2,158,862 | 5/1939 | Phelps | 200/51.09 |
| 2,688,669 | 9/1954 | Quill | 200/51.09 |

FOREIGN PATENT DOCUMENTS

| | | |
|---|---|---|
| 2724718 | 4/1979 | Fed. Rep. of Germany . |
| 2041568 | 1/1971 | France . |
| 2466114 | 9/1979 | France . |

*Primary Examiner*—John W. Shepperd
*Assistant Examiner*—Renee S. Kidorf
*Attorney, Agent, or Firm*—Spencer & Frank

[57] ABSTRACT

A lightbulb socket includes first and second contact members for electrically connecting two conductors and the central and side electrodes on the base of a bulb, and a threaded element for receiving the base of the bulb. The threaded element is held by spring action in a first position in relation to a shell of the socket when the bulb is unscrewed from the threaded element and is movable to a second position in relation to the shell against the spring action when the bulb is screwed into the threaded element. Coupling elements are arranged between the conductors and the contact members to break the contact therebetween when the threaded element is in its first position and to close the circuit to the bulb when the threaded element is brought to its second position. The coupling elements also serve as springs for moving the threaded element to its first position.

6 Claims, 5 Drawing Figures

LIGHTBULB SOCKET

BACKGROUND OF THE INVENTION

This invention refers to a socket for light-bulbs, comprising first and second contact members for electric contact between two electric conductors connected to the bulb-socket and the central and side electrodes respectively of the bulb and means for receiving the base of the bulb, said receiving means being by spring action held in a first position in relation to a shell of the socket when the bulb is unscrewed from the receiving means and bing movable to a second position in relation to the shell against said spring action when the bulb is screwed into the receiving means, coupling elements disposed between the conductors and said contact members on one hand breaking the contact therebetween when the receiving means is held in said first position and on the other hand closing the electric circuit to the bulb when the receiving means is brought to said second position.

To design bulb sockets in order to avoid unintentional contact with current carrying components inside the socket is previously well-known by for instance, German patent specification Nos. 472,593, 473,228, 492,234, 493,407, 906,128, 1,081,969, 1,539,415, 2,240,393, 2,262,974, 2,441,318, 2,442,063, 2,553,610, 2,651,334, 2,724,718 and 2,903,087; U.S. Pat. Nos. 2,439,385 and 3,895,195; and French patent specification No. 7,017,340 (publication number: 2,087,262), as well as Swedish patent publication Nos. 337,063, 7,202,203-1, 7,311,776-4 and 7,510,526-2.

The majority of the devices disclosed in the above-mentioned publications are based on the use of conventional receiving means for the socket (i.e., quite simply, the use of fixed thread on the inner surface of the sleeve-shaped socket shell itself) as well as a number of coupling elements which are directly or indirectly actuated by the introduction of the bulb into the receiving means and the removal of the bulb therefrom, respectively. A serious disadvantage of those devices is, however, that rather modest forces, exerted for instance by children, possible carrying electrically conductive objects, such as screw drivers, nails, screws, et cetera, are sufficient to manipulate the coupling elements and thereby render possible a switching of the coupling elements in such a manner that a current is supplied to the accessible contact members, with the ensuing risks of casualties. In order to eliminate this disadvantage, bulb sockets have been developed (see e.g. the above-mentioned U.S. Pat. No. 3,895,195) the receiving means of which are moveable in relation to the socket shell itself and are actuated by a spring force which tends to keep the receiving means in a first position in relation to the socket shell when the bulb is unscrewed, namely in a position in which the coupling elements cut the connection between the conductors and the contact members accessible in the receiving means, the receiving means being moveable against said spring force to a second position by continued rotation of the bulb after the bulb base has come into contact with the bottom of the socket shell. To try to manually move the receiving means of those bulb sockets to the position in which the coupling elements make the contact members current carrying is very difficult when the bulb is unscrewed and when a sufficiently great spring force exists. On the contrary even great spring forces are easily overcome when the bulb is screwed into the receiving means since then the thread of the bulb base exerts a powersaving wedge action in a known manner. Bulb sockets having movable spring-loaded receiving means therefore function well in comparison with other types of so called shock-proof bulb sockets.

Hitherto known bulb socket devices which are based on the use of spring-loaded movable receiving means are however—like other shock-proof bulb sockets in general—rather complicated in their structure. Thus the device disclosed for instance in U.S. Pat. No. 3,895,195 calls for a special mechanical spring, namely a compression spring, in order to achieve the necessary spring force on the receiving means, and for mounting the spring a special design of the the other components of the socket is necessary. In connection with multiple or mass production of articles of this kind it is extraordinary important that the number of components necessary and the number of working moments upon mounting thereof are as small as possible. For this reason the shock-proof bulb sockets previously known have been insignificantly used in practice, since they have been structurally complicated and accordingly badly competitive.

To combine a shortcircuiting mechanism with a device for effecting touch or shock protection in bulb sockets is per se previously known by the above-mentioned German patent specification No. 2,240,393. The bulb socket disclosed in said publication is, however, extremely complicated, and is based on the use of a receiving means fixed in the bulb socket shell rather than a movable springloaded receiving means according to the invention.

SUMMARY OF THE INVENTION

The object of the present invention is to eliminate the above-mentioned shortcomings of the previously known bulb sockets of the type in question and to provide a bulb socket which will function in a reliable manner and have an extremely simple, and thereby low-priced, structure. According to the invention this is achieved by the fact that one and the same member is made to simultaneously serve partly as a coupling element between a conductor and a contact member and partly as a spring for moving the receiving means to the above-mentioned first position. According to a preferred embodiment of the invention the first or central contact member is resiliently movable between a first position when the bulb is removed from the receiving means and a second position when the bulb is screwed into the receiving means, and includes a portion which extends from the zone of contact with the central electrode of the bulb to the zone of said second contact member or a conductor member associated therewith for bringing about electric contact between said two contact members when the bulb is unscrewed from the receiving means and thereby causing shortcircuiting of the current in case the coupling elements fail and do not properly break the contact between the conductors and the contact members when the bulb is unscrewed.

DETAILED DESCRIPTION OF THE PREFERRED EMBODIMENTS OF THE INVENTION

Figure 1:
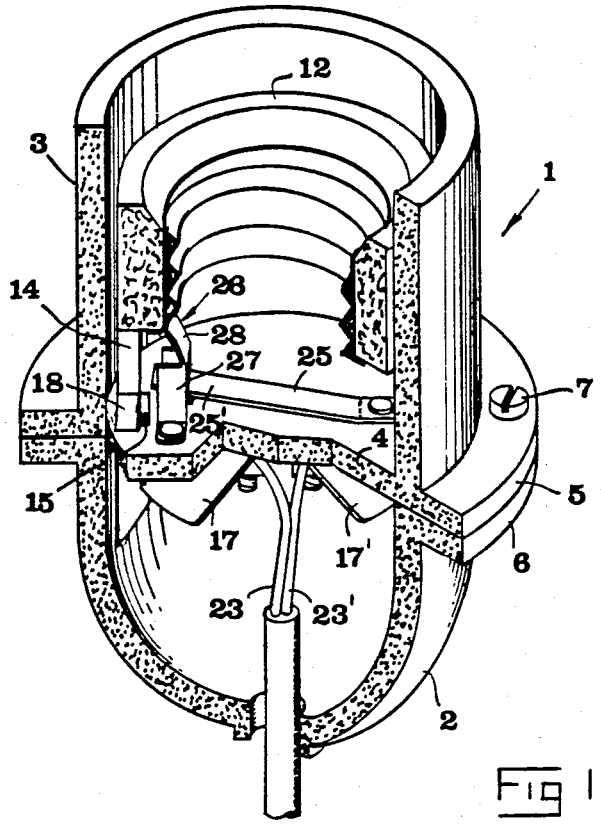
FIG. 1 is a partly cut perspective view illustrating the bulb socket of the invention without any bulb.
Figure 3:
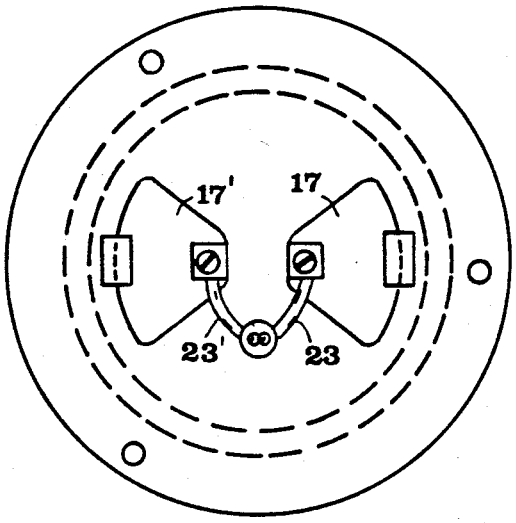
FIG. 3 is a sectional view taken along III—III in FIG. 2.
Figure 2:
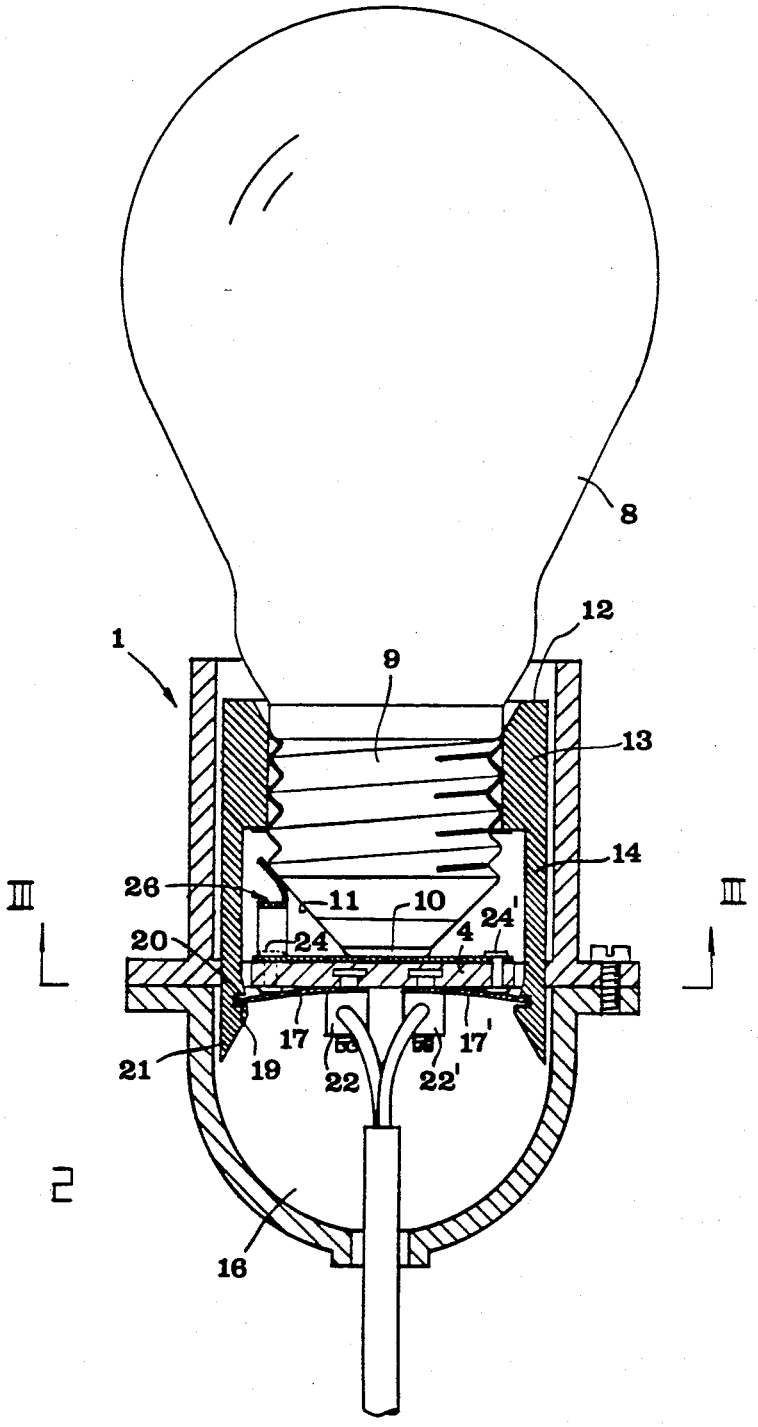
FIG. 2 is a cross-section through the bulb socket with the bulb applied therein.

The lightbulb socket 1 shown in FIGS. 1 to 3 includes a firm shell composed of two parts, namely a lower, substantially cap-shaped part 2 and an upper substantially cylindrical part 3 having a bottom 4. At the bottom of the upper part 3 and at the top of the lower part 2 flanges 5 and 6 are provided, said flanges having apertures for screws 7 or similar connecting members by means of which the two parts 2 and 3 are stiffly or immovably held together in their assembled condition. The lightbulb 8 shown in FIG. 2 includes in the usual manner an externally threaded base 9 having a central or bottom electrode 10 and a side electrode 11 insulated therefrom.

For receiving the bulb a receiving means 12 is arranged in the cylindrical upper shell part of the socket, said receiving means being movable in relation to the rest of the socket. In the example shown the receiving means comprises an internally threaded ring 12 and two axially extending legs 14 which project downwardly from said ring. These legs extend through apertures is in the bottom plate 4 so as to locate the bottom portions of the legs in the socket space 16 confined by the bottom plate 4 and the cap-shaped lower part 2. Though the apertures 15 may have a rather great dimension in the radial direction, they should, in the tangential direction, have a width which only slightly exceeds the width of the legs 14 so as to ensure that the legs will be guided with a rather close fit in relation to the apertures in this direction. Due to the fact that the legs are guided in the apertures 15 in this way a non-rotational connection is achieved between the receiving means in its entirety and the rest of the bulb socket.

FIG. 1 illustrates how the receiving means 12, when the bulb is unscrewed, is kept in a first position in relation to the socket shell by means of two spring members 17 and 17' which, according to the invention, serve not only as spring members, but also as coupling elements in a manner fully described below. In this case the spring members 17 and 17' consist of bent or curved spring leaves which at one of their ends are attached to the underside of the bottom plate 4 and each of which is connected to a leg 14 at the free end thereof. On each leg there is at least one stop member, e.g. a heel 18, which settles the lower position of the receiving means in relation to the bulb socket shell. The mechanical connection between the individual leg and the associated spring leaf may be realized in many ways. In the drawings it is shown how the free end of the spring leaf is located between upper and lower shoulders 19 and 20 respectively, created on one hand by the fact that a groove has been made in the inner surface of the leg and on the other hand by the fact that special projections have been made on the inside of the leg (the shoulders 19 and 20 may also be provided either by such projections alone or by a groove alone). The bottom portion 21 of the leg 14 is wedge-shaped or tapered from the shoulder 19 towards the lower tip. As seen from FIG. 2 the two spring leaves 17 and 17' are attached to the bottom plate 4 by means of the terminals 22 and 22' onto which the necessary conductors 23 and 23' (FIG. 1) are screwed in the usual manner. These terminals are conventionally fixed by being moulded into the bottom plate 4, which is made from an electrically insulating material.

In the areas between the terminals 22 and 22' and the free ends of the spring leaves 17 and 17', connector pins 24 and 24' made from an electrically conductive material are arranged, said pins intersecting the bottom plate 4. These pins 24 and 24' serve as attachments for two contact members, namely a first contact member 25 for contacting the central electrode 10 of the bulb and a second contact member 26 for contacting the side electrode 11 of the bulb. In the embodiment shown in FIGS. 1 to 3 the side contact member 26 consists of a metal yoke having two mutually spaced-apart side-pieces 27 projecting upwardly from the bottom plate 4, said side-pieces being interconnected by a top-piece 28. The first contact member 25 consists of a simple oblong metal leaf which extends not only from the connector pin 24 up to the zone of contact with the central electrode of the bulb, it also includes a portion 25' up to the zone of the side contact member 26. Due to portion extending 25' the two contact members 25 and 26 may—according to a particular aspect of the invention—form a shortcircuiting mechanism which will under all circumstances guarantee the absence of current in the contact members when the bulb 8 is unscrewed.

The bulb socket described above operates in the following manner: In the condition illustrated in FIG. 1, when no bulb is present in the socket, the receiving means 12 is moved to its lower position by the spring leaves 17 and 17' acting on the lower shoulders 19 of the legs 14. In this condition the two contact members 25 and 26 are positively currentless, since the spring leaves 17 and 17' serving as coupling elements are removed from the connector pins 24 and 24'.

When the bulb 8 is screwed into the socket nothing happens at first, except that the base 9 moves downwardly through the receiving ring 13 and that the first contact member 25 is urged against the bottom plate 4, i.e. brought out of contact with the contact member 26. Upon continued rotation of the bulb 8, after the bottom electrode 10 and the contact member 25 have advanced to touch the bottom plate 4, the receiving means 12 will—due to the co-operation between the external threads of the bulb base and the internal threads of the receiving means—be moved upwardly in relation to the socket shell against the action of the spring leaves 17 and 17'. This upward movement is continued until the spring leaves 17 and 17' come into contact with the connector pins 24, 24'. This means that the circuit to the bulb is closed through the conductor 23, terminal 22, spring leaf 17, connector pin 24, contact member 26, side electrode 11, bulb 8, central electrode 10, contact member 25, pin 24', leaf 17', terminal 22' and conductor 23'.

When the bulb 8 is unscrewed the inherent spring force of the spring leaves 17 and 17' on one hand returns receiving ring 13 to its bottom position, shown in FIG. 1, and on the other hand returns the spring leaves themselves to their initial positions as shown in FIG. 1, so that the electrical contact with the pins 24 and 24' is ended. This function is the normal one. It is however conceivable that one of the spring leaves, by being heated, will stick more or less firmly to the associated connector pin, e.g. after using the same bulb for a long time. In case such a sticking is not too severe, the upper shoulder 20 of the leg 14 co-operating with the spring leaf in question will quarantee that the spring leaf is carried away in connection with the downward movement that can take place if the spring force of the spring leaf which is not stuck is capable of overcoming the holding forces at the point of inter-connection. If said spring force is not great enough or if perchance both of the spring leaves are stuck to the associated connector pins, the receiving means 12 will of course remain in the upper position in spite of the bulb being unscrewed, what would normally result in both contact members 25 and 26 becoming current carrying. However, since portion 25' extends from the contact member 25, short circuiting will occur as soon as portion 25' comes into contact with the second contact member 26. The two contact members will, in other words, be positively currentless before the bulb has been unscrewed from the receiving means irrespective of whether the spring leaves 17 and 17' serving as coupling elements function perfectly or not (the only thing happening when the coupling elements fail is that the fuse in question blows).

Figure 4:
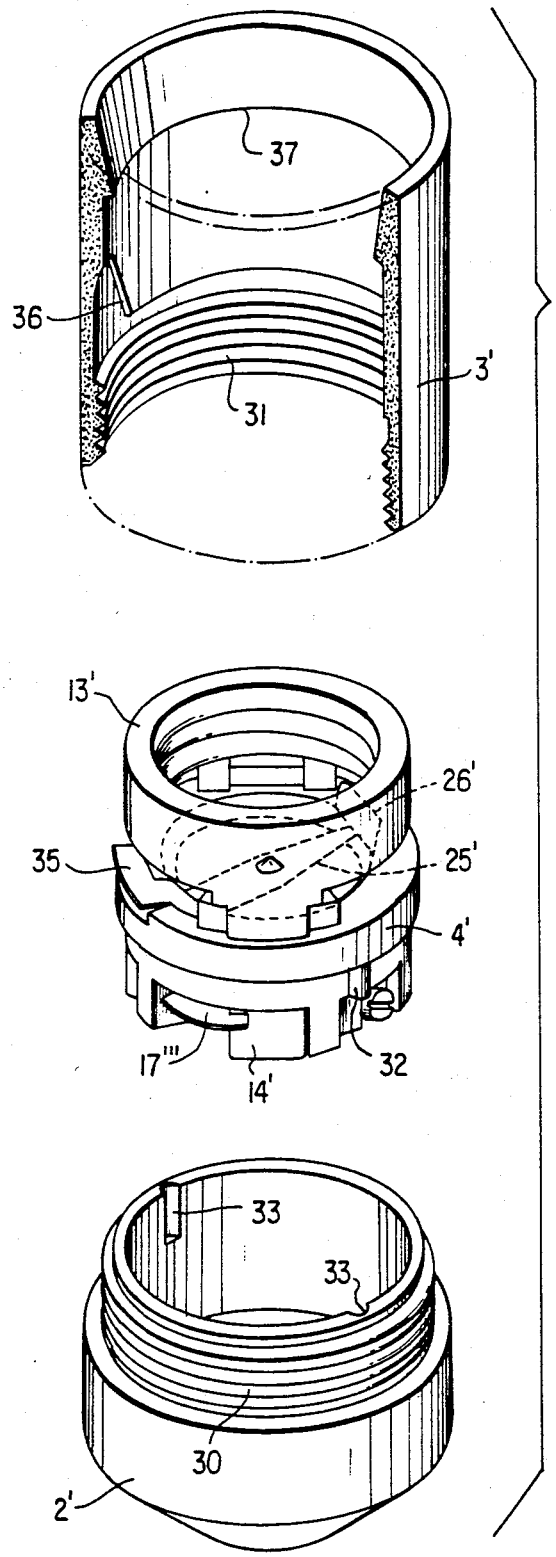
FIG. 4 is an exploded view illustrating a modified embodiment of the invention.
Figure 5:
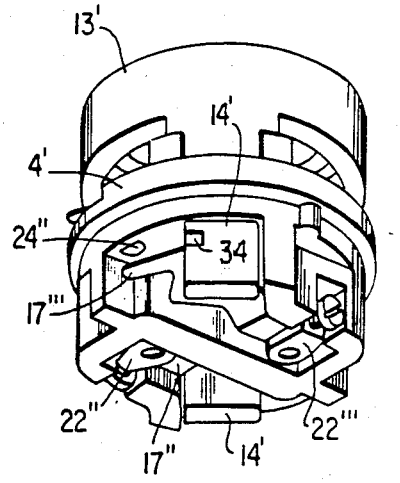
FIG. 5 is a perspective view of a component therein.

FIGS. 4 and 5 illustrate an alternative embodiment which has been further developed in comparison with the embodiment of FIGS. 1 to 3. In the embodiment of FIGS. 4 and 5 the shell parts 2' and 3' are connected to each other by means of threads 30 and 31, the bottom plate or partition 4' being removably clamped between said parts 2' and 3', when they are screwed together. In order to support the partition 4' in a non-rotational manner in relation to the shell it is provided with projections 32 for engagement with corresponding recesses 33 in the shell part 2'.

The first contact member 25'' consists of a resilient metal plate having at one end thereof a downwardly bent lug which intersects the partition 4' and which is perpendicularly bent at 24'' on the underside of the partition. This lug serves the same purpose as the pin 24' in the embodiment of FIGS. 1 to 3, i.e., to attach the contact member to the partition and simultaneously form a connector element for contacting the underlying coupling element. In a corresponding way the second contact member 26' includes a lug (not visible) intersecting the partition 4', said lug being perpendicularly bent in the region of the underside of the partition while forming a connector element which replaces the pin 24 according to FIGS. 1 to 3.

In this case the legs 14' are formed with side-pointing recesses 34 which co-operate with the free ends of combined spring and coupling elements 17'' and 17''' located side by side. These spring and coupling elements, which are attached to the partition 4 by means of the terminals 22'' and 22''', have shapes such that portions thereof are located below the connector elements 24'' so as to contact the latter elements when the bulb is screwed into the socket.

It should further be noted that the first contact member 25'' is formed with a dog 35 which in a manner known per se cooperates with a stopping edge 36 provided in the inner surface of the shell part 3' while forming a locking mechanism which prevents the shell part 3' from being unintentionally unscrewed from the shell part 2'. When the parts 2' and 3' should be loosened from each other the dog 35 has to be pressed down so as to disengage it from the edge 36.

In the embodiment of FIGS. 4 and 5 the shell part 3' includes an internal annular rib 37 serving as a stop member for the receiving ring 12 when the bulb is screwed into the ring.

Of course the geometric design of the few components included in the lightbulb socket according to the invention may be varied and modified within broad limits. In this connection it should, however, be stressed that the two spring and coupling elements advantageously are identical as to their shape, thereby reducing the number of components having different designs to an absolute minimum.

What I claim is:

1. A socket for connecting two electric conductors to a lightbulb having a threaded base with side and central electrodes, comprising:

a shell having an electrically insulating partition dividing the shell into a first region and an outwardly open second region, said partition having at least two apertures therein;

an element having an internally threaded receiving ring disposed in the second region of the shell to receive the base of the bulb, said element having at least two electrically insulating legs which extend through said at least two apertures in said partition and which have ends disposed in the first region of the shell, said element being movable between a first position in relation to the shell when the bulb is unscrewed from the receiving ring and a second position in relation to the shell when the bulb is screwed into the receiving ring;

first and second contact members mounted in the second portion of the shell for electric contact with the central and side electrodes of the bulb, respectively;

a pair of connector elements in electrical contact with said first and second contact members respectively, said connector elements passing through said partition; and spring means for biassing said element toward said first position and for additionally electrically coupling said contact members to respective ones of said electric conductors when said element is in said second position and breaking the electrical coupling when the element is in said first position, said spring means including a pair of bent or curved spring leaves disposed within the first region of the shell, each spring leaf being at one point attached to the partition, being mechanically connected, at a point spaced apart from said point of attachment, to a respective leg of said element adjacent an end thereof, being located adjacent a respective connector element so as to contact the respective connector element when the spring leaf is straightened by screwing the bulb into the receiving ring, and being electrically connected to a respective one of the electric conductors.

2. The socket of claim 1, wherein said spring leaves are identically shaped.

3. The socket of claim 1, wherein each leg has a top portion and a bottom portion which includes the end of the leg, the spring leaves being mechanically connected to the respective legs between the top and bottom portions thereof, and further comprising, for each leg, a bottom shoulder affixed to the bottom portion of the leg to transmit force from the spring leaf that is mechanically connected to the leg in order to bias the element in the first position, and a top shoulder affixed to the top portion of the leg to dislodge the spring leaf that is mechanically connected to the leg if the spring leaf becomes stuck by transmitting force from a leaf spring mechanically connected to another leg.

4. The socket of claim 1, wherein the contact members are mounted by the connector elements.

5. The socket of claim 1, wherein said first contact member is resiliently movable between a first position when the bulb is removed from the receiving ring and a second position when the bulb is screwed into the receiving ring, wherein the central electrode electrically contacts said first contact member at a zone of contact when the bulb is screwed into the receiving ring, and wherein said first contact member includes a portion extending from said zone of contact, said portion being located to come into electrical contact with said second contact member when the bulb is unscrewed from the receiving ring and said first contact member moves to its first position so as to ensure that there is no voltage difference between the first and second contact members when the bulb is not screwed into the receiving ring even if said spring means fails to break the electrical coupling between the contact members and the electric conductors.

6. The socket of claim 5, wherein said portion of said first contact member extending from said zone of contact extends directly toward said second contact member.

* * * * *